United States Patent [19]

Cash

[11] Patent Number: 4,934,550

[45] Date of Patent: Jun. 19, 1990

[54] RAKE STORAGE DEVICE

[76] Inventor: David B. Cash, 900 Bellview St., Winston-Salem, N.C. 27103

[21] Appl. No.: 387,158

[22] Filed: Jul. 31, 1989

[51] Int. Cl.[5] ..... B65D 85/00

[52] U.S. Cl. ..... 220/18

[58] Field of Search ..... 220/18; 206/244, 315.2, 206/349, 443

[56] References Cited

U.S. PATENT DOCUMENTS

| | | | |
|---|---|---|---|
| 60,078 | 11/1866 | Speirs | 206/244 X |
| 2,757,045 | 7/1956 | Nullet | 220/18 X |
| 2,791,347 | 5/1957 | Bochm | 220/18 X |
| 3,515,263 | 6/1970 | Carlson | 220/18 X |
| 4,838,416 | 6/1989 | Carman | 206/315.2 |

*Primary Examiner*—Steven M. Pollard

*Attorney, Agent, or Firm*—H. Jay Spiegel

[57] ABSTRACT

The present invention relates to a storage device for a rake which includes a chamber designed to receive a rake, which chamber is buried under the ground surface. The chamber includes a first subchamber designed to receive the rake handle and a second subchamber designed to receive the rake head. The second subchamber has an upper opening provided to allow easy insertion and removal of the rake.

7 Claims, 2 Drawing Sheets

RAKE STORAGE DEVICE

BACKGROUND OF THE INVENTION

The present invention relates to a rake storage device. In the prior art, underground storage devices are known. U.S. Pat. No. 2,274,451 to Kyle discloses a receptacle for a garbage can which is designed to be underground. However, no prior art is known to applicant which specifically discloses a storage device specifically sized and configured to receive a rake.

SUMMARY OF THE INVENTION

The present invention relates to a rake storage device. The present invention includes the following interrelated aspects and features:

(a) In a first aspect, the inventive storage device includes a chamber sized and configured to receive a rake therein, which chamber is intended to be buried in the ground.

(b) The chamber includes a first elongated subchamber sized and configured to receive the handle of a rake and a second subchamber sized and configured to receive the head of the rake.

(c) The second subchamber is upwardly open when the inventive storage device is buried in the ground to allow easy access to the second subchamber to allow insertion therein and removal therefrom of a rake.

(d) Surrounding the opening in the second subchamber is an outwardly protruding lip designed to limit the extent of insertion of the inventive storage device into the ground.

Accordingly, it is a first object of the present invention to provide an improved rake storage device.

It is a further object of the present invention to provide such an improved rake storage device including a chamber formed of two subchambers which are sized and configured to receive the handle and head of a rake.

It is a further object of the present invention to provide such a device which may be inserted in the ground adjacent a sand trap on a golf course.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
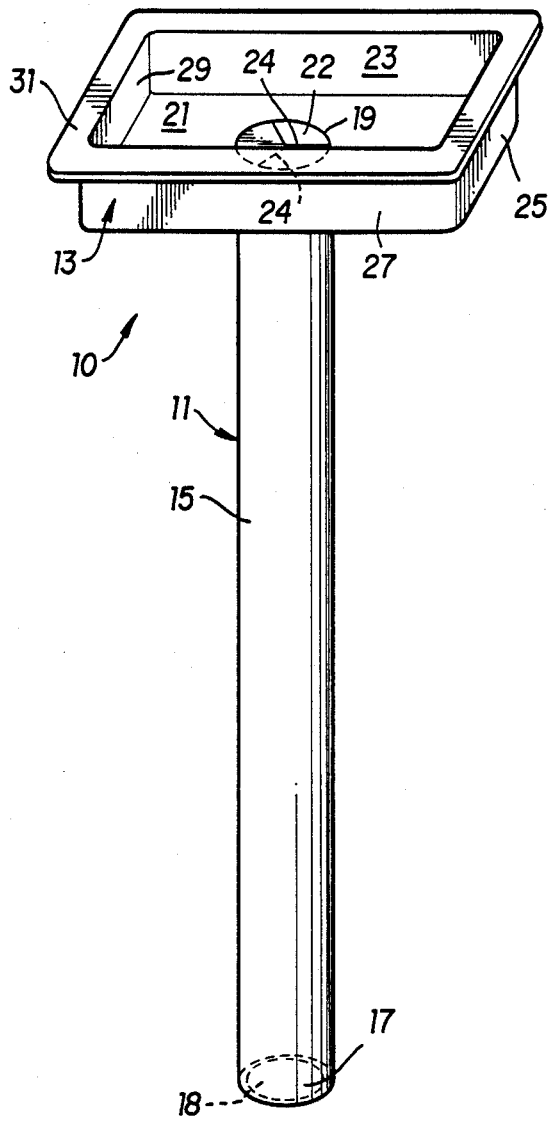
FIG. 1 shows a prospective view of the present invention.

With reference, first, to FIG. 1, the inventive rake storage device is generally designated by the reference numeral 10 and includes a chamber consisting of a first subchamber 11 and a second subchamber 13.

The first subchamber 11 consists of an elongated tube 15 having a bottom 17 open at 18 to allow drainage and an upper opening 19. The upper opening 19 opens to the second subchamber 13 at a floor surface 21 thereof. A seal 22 is mounted on the opening 19 and has slits 24 therethrough.

The second subchamber 13 also includes four side walls 23, 25, 27 and 29. Each of these walls extends upwardly until a termination point defined by an outwardly extending lip 31 which completely surrounds all of the walls.

Figure 2:
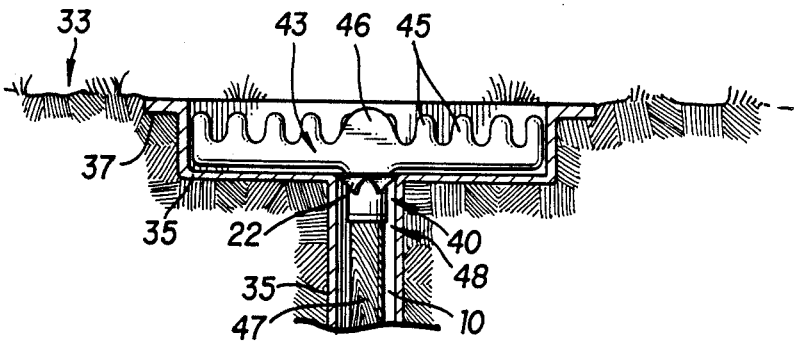
FIG. 2 shows a side view of the present invention as installed in the ground.

With reference to FIG. 2, a ground surface 33 is shown and also shown is a recess 35 formed in the ground under the ground surface 33 and which is specifically configured to snugly receive the inventive storage device 10.

The recess 35 also includes a sub-recess 37 designed to receive the lip 31 of the storage device 10 to prevent further deepening of the position of the storage device 10 in the ground.

With further reference to FIG. 2, a rake 40 is seen to include an elongated handle and a head 43 having a plurality of teeth 45 thereon. As seen in FIG. 2, the first subchamber 11 is sized and configured to receive the handle 41 of the rake 40 while the second subchamber 13 is sized and configured to receive the head 43 of the rake 40. The rake 40 has a grasping ring 46 allowing the rake 40 to be pulled out of the device 10.

Figure 3:
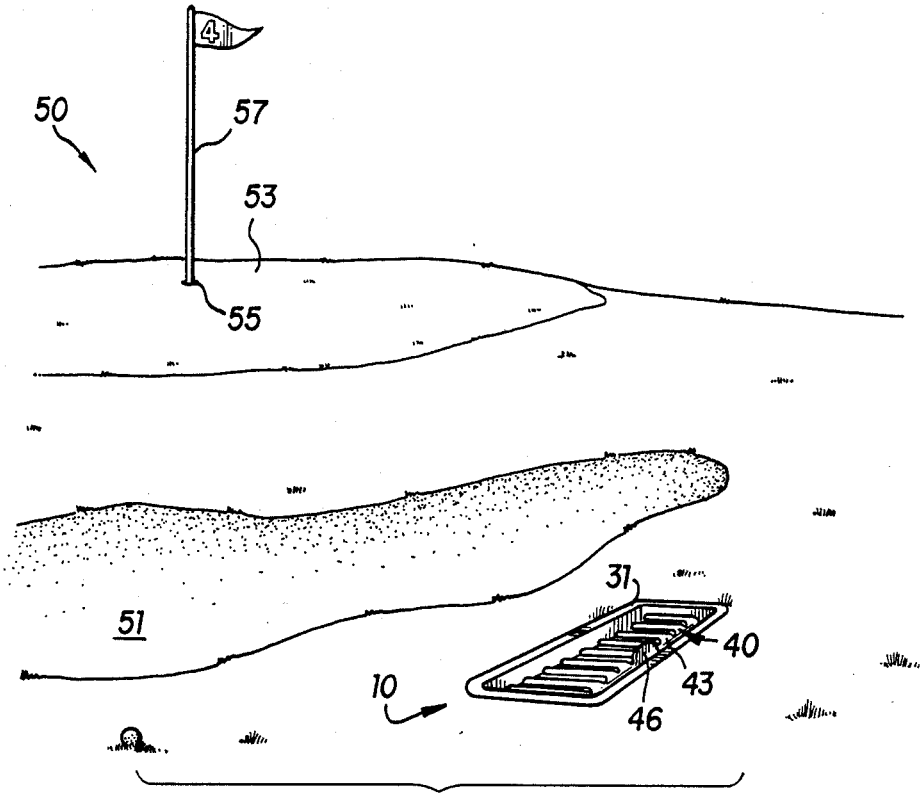
FIG. 3 shows a prospective view of a contemplated environment of use of the present invention.

With reference to FIG. 3, an environment of contemplated use of the present invention is shown. This environment consists of a golf course 50 having a sand trap 51, a putting green 53, a golf hole 55, and a flag 57. As seen, one environment of contemplated use of the present invention consists of that area specifically adjacent a sand trap 51 of a golf course 50. As is known, it is desirable to provide a rake adjacent a sand trap to allow smoothing of the sand trap after a golfer has used a wedge to remove the golfer's ball therefrom. Often, this rake is merely placed on the ground adjacent the sand trap, which causes a danger to exist that a golfer will inadvertently step on the head of the rake, causing the handle thereof to fly up into the golfer's face, thus causing injury. The use of the present invention, as shown in FIG. 3, will completely and positively prevent this possibility from occurring, since the present invention provides a storage device for the rake which allows the rake to be completely visible to the golfer, while completely preventing any possibility of injury from stepping on the rake.

Of course, the example shown in FIG. 3 is merely exemplary of the uses to which the present invention may be used. Any ground area may be excavated to provide a recess for the inventive storage device 10 as the user desires.

As such, an invention has been disclosed in terms of a preferred embodiment thereof which fulfills each and every one of the objects of the invention as set forth herein-above and provides a new and improved rake storage device which enhances convenience and safety for the users. Of course, various changes, modifications, and alterations in the teachings of the present invention may be contemplated by those skilled in the art without departing from the intended spirit and scope of the present invention. As such, it is intended that the present invention only be limited by the terms of the appended claims.

I claim:

1. An improved storage device, comprising:

(a) a chamber including a first elongated subchamber and a second subchamber connected to said first subchamber;

(b) said first subchamber adapted to receive a handle of an implement;

(c) said second subchamber adapted to receive a head of said implement when said handle is contained in said first subchamber;

(d) said second subchamber having an opening remote from said first subchamber through which said implement may be inserted into said storage device;

(e) said storage device being buried underground with said opening outwardly exposed.

2. The invention of claim 1, wherein said opening is surrounded by an outwardly extending lip.

3. The invention of claim 1, wherein said second subchamber is of generally rectangular cubic configuration.

4. The invention of claim 1, wherein said implement comprises a rake.

5. The invention of claim 1, wherein said first subchamber comprises an elongated tube.

6. The invention of claim 1, wherein a seal is provided at an intersection of said first and second subchambers, said seal having a slit allowing said handle to be inserted therethrough.

7. The invention of claim 1, said implement having a grasping ring.

* * * * *